US005148912A

United States Patent [19]

Nozawa

[11] Patent Number: 5,148,912

[45] Date of Patent: Sep. 22, 1992

[54] CAP CLOSING MEMBER FOR CONTAINER OPENING

[75] Inventor: Takamitsu Nozawa, Koto, Japan

[73] Assignee: Yoshino Kogyosho Co., Ltd., Tokyo, Japan

[21] Appl. No.: 661,237

[22] Filed: Feb. 27, 1991

[51] Int. Cl.[5] ..... B65D 43/14

[52] U.S. Cl. ..... 220/339; 220/337; 220/375; 215/235

[58] Field of Search ..... 220/339, 337, 375; 215/235

[56] References Cited

U.S. PATENT DOCUMENTS

| | | | |
|---|---|---|---|
| 3,628,215 | 12/1971 | Everburg | 220/339 X |
| 4,403,712 | 9/1983 | Wiesinger | 220/339 |
| 4,545,495 | 10/1985 | Kinsley | 220/339 X |
| 4,638,916 | 1/1987 | Beck et al. | 215/235 |
| 4,854,473 | 8/1989 | Dubach | 215/235 X |
| 4,915,268 | 4/1990 | Lay et al. | 220/339 X |
| 5,007,555 | 4/1991 | Beck | 220/339 |
| 5,067,624 | 11/1991 | Thanisch | 215/235 |

*Primary Examiner*—Stephen Marcus
*Assistant Examiner*—Paul A. Schwarz
*Attorney, Agent, or Firm*—Oliff & Berridge

[57] ABSTRACT

A cap closing member for a container opening includes a main body and a lid having the same cross-sectional shape, rear surfaces of the main body and lid being connected to each other by two resilient belt plates. Each of the resilient belt plates forms a trapezoid with top sides that are oppositely faced to each other and connected to the rear surface of the lid. Each of the resilient belt plates is connected to the rear surface of the main body and a rear surface of the lid, so that the resilient belt plates do not project rearwardly from the circular cross-section of the lid or the circular cross-section of the main body.

13 Claims, 9 Drawing Sheets

CAP CLOSING MEMBER FOR CONTAINER OPENING

BACKGROUND OF THE INVENTION

This invention relates to a cap closing member for a container opening and more particularly a cap closing member provided with a resilient repelling lid.

Many type of containers with a resilient repelling lid are well known in the art and their typical lid is a so-called three-point hinged cap in the prior art.

The cap described above is constructed such that a rear upper end of a main body of the cap and a rear lower end of the lid mounted on the upper surface of the cap to close a pouring port formed in the upper surface of the cap are connected by a pair of first right and left hinges properly spaced apart.

A lower end of an inverted U-shaped resilient plate arranged between the first hinges is connected to a rear part of the main body of the cap lower than the first hinge through a second hinge.

In addition, the other end of the resilient plate is connected to the upper surface of the more forward lid than the first hinge through the third hinge.

In addition to the foregoing prior art, there is Japanese Utility Model Application Sho 63-71518 filed in Japan by the present applicant.

This utility model is made such that a circular container and a similar circular lid for closing the upper surface of the container in such a way as it may be opened or closed are connected to each other by the first resilient connector plate through a thin-walled hinge.

At both right and left sides of the first resilient plate, their lower ends are connected to an outer surface of the container and their upper ends are connected to an outer surface of the lid through a thin-walled hinge, respectively, with the second and third wider resilient connector plates longer than the first resilient plate.

When the lid is closed, the second and third resilient connector plates as viewed from above are resiliently repelled from a truncated V-shape in cross section and in turn when the lid is released to open, the resilient connector plates are resiliently repelled from their truncated V-shape in cross section to an inverted truncated V-shape as viewed from a rear side thereof.

In case of the prior art cap provided with a lid of a three-point hinge mechanism, its outer appearance is deteriorated due to the fact that its inverted L-shaped resilient plate is exposed at an outer surface of a rear half part of a top wall of the lid.

In addition, in case of this prior art, the right and left outer ends of the first hinge are projected in outward edge form, resulting in that their projections may deteriorate a user's feeling in touching operation.

Further, it sometimes occurs that some dusts enter slits and further enters into the cap. The lid has slits which are formed in the cap so as to make the aforesaid inverted L-shaped resilient plate.

In addition, since the L-shaped resilient plate or the first hinge is projected, the projection may hinder a closing operation of the cap with an automatic cap device and so it shows a problem that the cap may not be grasped.

The present invention has as its own issue of a resolving the aforesaid problem and it is an object of the present invention to provide a lid closing member for a container opening having such a structure as one in which the hinge part is projected rearwardly.

SUMMARY OF THE INVENTION

The lid closing member for the container opening of the present invention is comprised of a main body (1) having a circular cross section with a pouring port (2) at its upper surface, a lid (3) for closing the pouring port (2) and having the same cross-sectional shape as that of the main body (1) mounted on the upper surface of the main body (1), and at least two resilient belt plates (7, 7) for use in connecting rear side surfaces of the main body (1) and the lid member (3) to each other.

In this case, each of the resilient belt plates (7, 7) forms a trapezoid having a bottom side (*7a*) and a top side (*7b*) which are parallel to each other, and a pair of slant sides (*7c, 7d*) connecting both ends of the bottom side (*7a*) with both ends of the top side (*7b*), respectively.

Each of the resilient belt plates (7, 7) is connected to a rear side surface of the lid member (3) while its top sides (*7b, 7b*) being oppositely faced to each other. In this case, one slant side (*7c*) of each of the resilient belt plates (7, 7) is low and connected to a rear surface of the main body (1) through a thin-walled hinge (10), and the other slant side (*7d*) of each of the resilient belt plates (7, 7) is high and connected to the rear side surface of the lid (3) through a thin-walled hinge (11).

Each of the resilient belt plates (7, 7) is connected to the rear side surface of the main body (1) having a circular cross-section and the rear side surface of the lid (3) having a circular cross-section, resulting in producing a relation in which a cross-sectional shape crossing at a right angle with the resilient belt plates (7, 7) may show an inverted truncated V-shape.

In case of opening or closing the lid (3), each of the resilient belt plates (7, 7) may be primarily reversed as the lid (3) is pivoted around a center of the upper thin-walled hinge (11) and secondarily reversed as each of the resilient belt plates (7, 7) is pivoted around a center of the lower thin-walled hinge (10), resulting in that a sectional shape crossing at a right angle with the resilient belt plates (7, 7) shows a truncated V-shape.

With such an arrangement of the present invention as described above, the resilient belt plates are provided at the rear side surfaces of the main body and the lid, resulting in that they may not deteriorate an outer appearance caused by an exposure of the resilient belt plates on the upper surface of the lid as found in the container having the lid formed by the prior art three-point hinge mechanism.

BRIEF DESCRIPTION OF THE DRAWINGS

FIG. 1 is a top plan view for showing a lid closing member of the first preferred embodiment.

FIG. 2 is a side elevational view of FIG. 1.

FIG. 3 is a rear view for showing a lid closed state.

FIG. 4 shows a shape of right crossed section of a resilient belt plate.

FIG. 5 is an illustrative view for showing an opening or closing of a lid caused by a resilient reversing of the resilient belt plate.

FIG. 6 is a side elevational view of the second preferred embodiment.

FIG. 7 is a top plan view of FIG. 6.

FIG. 8 is a rear view for showing a lid closed state.

FIG. 9 is an illustrative view for showing an opening or closing of a lid under a resilient reversing of each of the resilient belt plates.

FIG. 11 is a top plan view of the fourth preferred embodiment.

FIG. 12 is a side elevational view of FIG. 11.

FIG. 13 is a rear view with the resilient belt plates being broken away.

DESCRIPTION OF THE PREFERRED EMBODIMENTS

Figure 1:
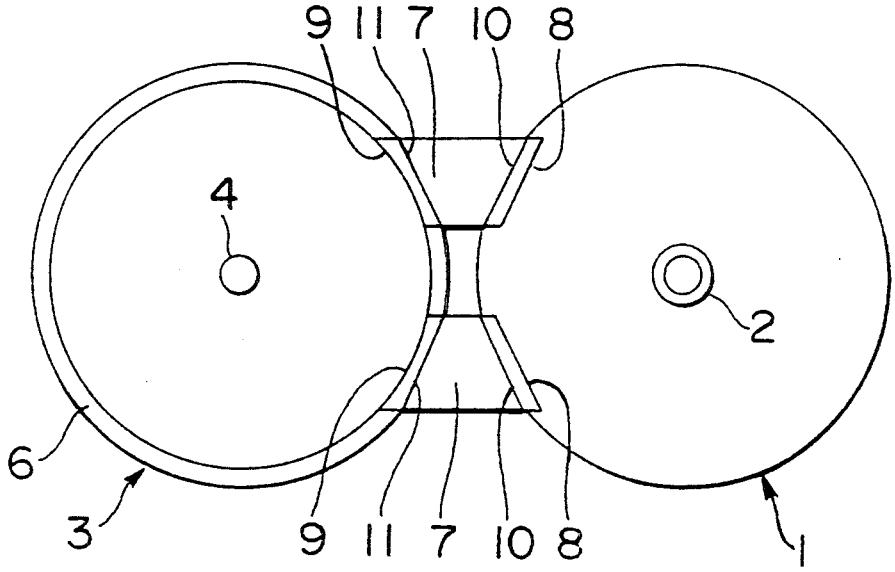
FIGS. 1 to 5 illustrate the first preferred embodiment.
Figure 2:
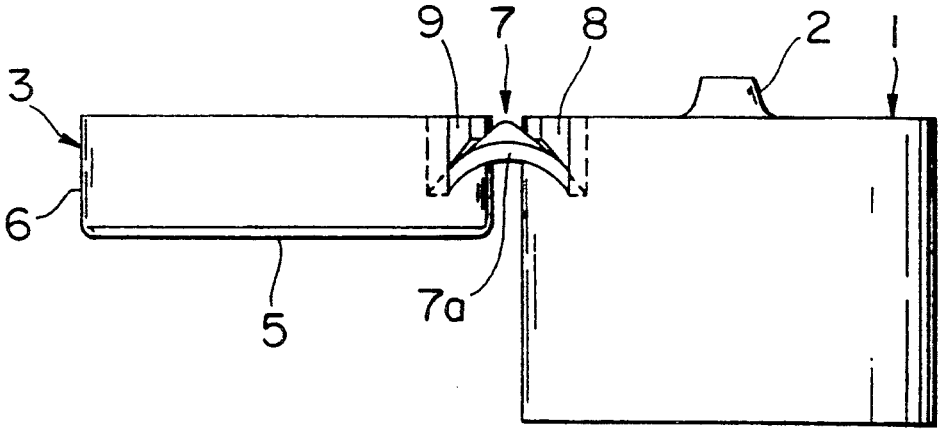

Referring now to the drawings, some preferred embodiments of the present invention will be described.

First Preferred Embodiment

In FIGS. 1 to 4, reference numeral 1 denotes a main body having a circular cross-section with an opening 2 at its upper surface. The main body 1 may be formed of a cap with its lower end surface being released to open or of a container with its lower end surface being closed.

Reference numeral 3 denotes a lid mounted on the upper surface of the main body 1 to close the opening 2. The lid has the same cross-sectional shape as that of the main body 1. In this example, the main body 1 and the lid 3 are circular shape as viewed from their top surfaces.

The lid 3 shown in the figure is vertically provided with a plug 4 to be fitted into the opening 2 from a central lower surface thereof and has a peripheral wall 6 vertically suspended from a top plate 5 thereof.

There are provided at least a pair of resilient belt plates 7 for use in connecting the rear side surfaces of the main body 1 and the lid 3 to each other. The main body 1 and the lid 3 are provided with, at their rear right and left side surfaces grooves 8 and 9 communicating to each other in a longitudinal direction over the main body 1 and the lid 3 when the lid 3 is closed in correspondence with a pair of resilient belt plates 7.

Each of the lower ends of the resilient belt plates 7 is connected to the lower ends of the grooves 8 and 9 through the thin-walled hinges 10, and each of the upper ends of the resilient belt plates 7 is connected to the upper ends of the grooves 8 and 9 through the thin-walled hinges 11.

When the lid is closed over the cap, a pair of resilient belt plates 7 are stored within each of the grooves 8 and 9.

Figure 3:
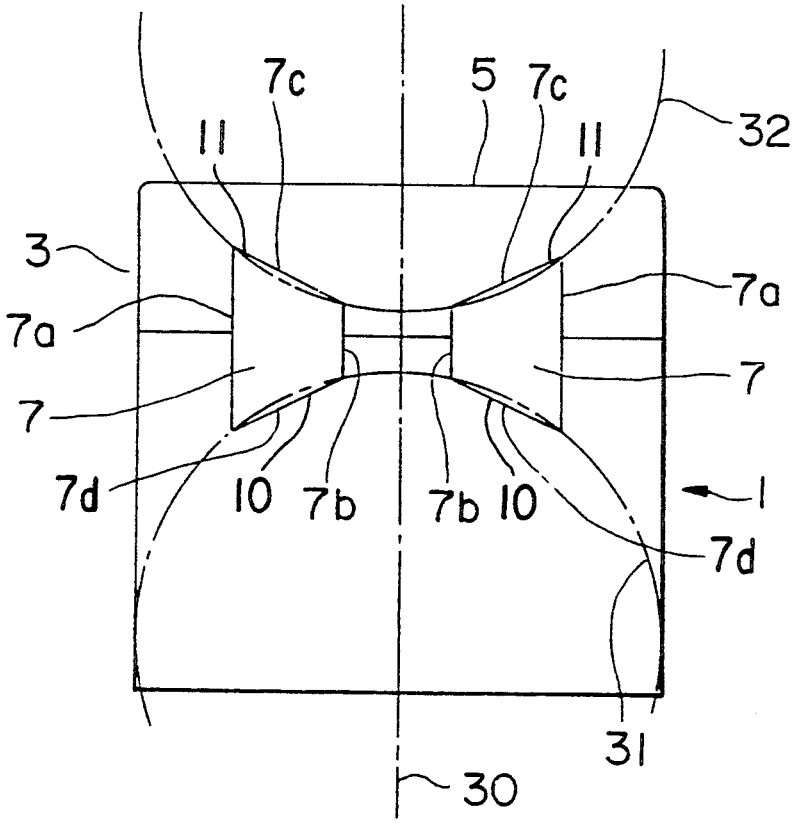

In this case, each of the resilient belt plates 7 may form as shown in FIG. 3 a trapezoid having the bottom side 7*a* and the top side 7*b* which are parallel to each other and further having a pair of slant sides 7*c* and 7*d* connecting each of both ends of the bottom side 7*a* and both ends of the top side 7*b*.

Each of the resilient belt plates 7 and 7 is connected such that their top sides 7*b* and 7*b* are oppositely faced to each other and connected to the rear side surface of the lid 3. At this time, one slant side 7*d* of each of the resilient belt plates 7 is low and connected to the rear surface of the main body 1 through the thin-walled hinge 10, the other slant side 7*c* of each of the resilient belt plates 7 is high and connected to the rear surface of the lid 3 through the thin-walled hinge 11.

Figure 4:
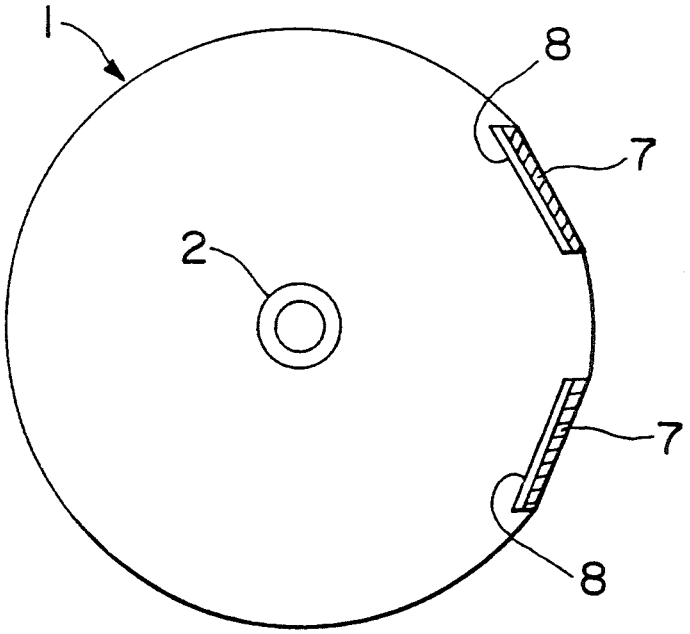

As shown in FIG. 3, each of the resilient belt plates 7 is connected to the rear side surface of the main body 1 (having a circular cross-section) and the rear side surface of the lid 3 (having a circular cross-section), thereby the cross-sectional shape of the plates crossing at a right angle with the resilient belt plates 7 forms an inverted truncated V-shape as shown in FIG. 4.

In addition, as viewed from the rear side surfaces of the main body 1 and the lid 3, both ends of the thin-walled hinges 10 at the lower side of each of the resilient belt plates 7 are placed on a curved line 31 drawn to extend upwardly around a center of curvature of any point on a center line 30 between the two resilient belt plates 7. Both ends of the upper thin-walled hinges 11 are placed on a curved line 32 drawn to extend downwardly with a center of curvature of any point on a center line 30 between the two resilient belt plates 7.

A curvature of each of the curved lines 31 and 32 is the same as that of a circle as viewed from above the main body 1 and the lid 3.

When the lid 3 is opened, the bottom sides 7*a* of the resilient belt plates 7 are expanded upwardly to form arcular shapes.

An example of operation of this preferred embodiment will be described referring to FIG. 5.

At first, under the closed condition of the lid, the cross-sectional shape of the plates crossing at a right angle with the resilient belt plates 7 draws an inverted truncated V-shape. Due to this fact, as viewed from the side of each of the resilient belt plates 7, the thin-walled hinge 11 is seemed to cross with a horizontal line $A_1$–B at an angle $\beta$ as shown in FIG. 5.

From this state, at first when the lid 3 is pivoted on a crossing point $O_1$ between the top side 7*b* and the upper thin-walled hinge (the upper slant side) 7*c* (11), a crossing point $A_1$ between the bottom side 7*a* of the resilient belt plate 7 and the upper slant side 7*c* is moved on an arc $S_1$ with its radius being a distance $R_1 = m \times \sin\theta \times \cos\beta$ (where, m is a length as viewed from the upper surface of the hinge) between $O_1A_1$ as viewed from a side around a point $O_1$.

To the contrary, when the lid 3 is pivoted on a crossing point $O_3$ between the bottom side 7*a* and the lower thin walled hinge (the lower slant side) 7*d*, the crossing point $A_1$ between the bottom side 7*a* and the upper slant side 7*c* of the resilient belt plate 7 is moved on an arc $S_2$ with a radius having a length $R_2$ of the bottom side 7*a*.

Due to this fact, the resilient belt plate 7, in particular, its bottom side 7*a* is resiliently extended from the point $A_1$ up to an intermediate point $P_1$ applying the maximum spacing distance C between each of the arcs $S_1$ and $S_2$ and when it exceeds this intermediate point $P_1$, it may resiliently be recovered. With such an arrangement, the primary reversing is completed.

Then when the lid 3 is pivoted on a crossing point $O_2$ between the top side 7*b* and the lower thin-walled hinge (a lower slant side) 7*d* the crossing point $A_1$ between the bottom side 7*a* and the upper slant side 7*c* of the resilient belt plate 7 is moved on an arc $S_3$ having a center of $O_2$ and a radius of a distance $R_3 = m \times \sin\theta \times \cos\alpha$ between $O_2$ and $A_1$ as viewed from the side thereof with $O_2$ being applied as a center.

To the contrary, when the lid 3 is pivoted on the crossing point $O_3$ between the bottom side 7*a* and the lower thin-walled hinge (the lower slant side) 7*d* the crossing point $A_1$ between the bottom side 7*a* and the upper slant side 7*c* of the resilient belt plate 7 is moved on an arc $S_2$ with a radius having a length $R_2$ of the bottom side 7a.

Due to this fact, the resilient belt plate 7, in particular its bottom sides 7a are resiliently expanded from the point $A_1$ to the intermediate point $P_2$ applying the maximum spacing distance D between each of the arcs $S_3$ and $S_2$ and as it exceeds the intermediate point $P_2$, subsequently it is resiliently recovered to form an upward arc S connecting the points $O_3$ and $A_3$ and then the secondary reversing is completed. As a result, the cross-sectional shape crossing at a right angle with the resilient belt plates 7 becomes a truncated V-shape.

A primary reversing around a center of $O_1$ and a secondary reversing around a center $O_2$ are normally performed continuously with an integral operation. Provided that it is also possible to keep the lid in its half-opened state under a state of the primary reversing operation.

In the preferred embodiment, the bottom side 7a of the resilient belt plate 7 is formed arcularly to expand upwardly when the lid 3 is opened, so that an allowance of a resilient extension of the bottom side 7a is increased. Therefore, even if an excessive tension force is applied to the thin-walled hinges 10 and 11 at both ends of the resilient belt plates, these thin-walled hinges 10 and 11 are never torn off.

Figure 5:
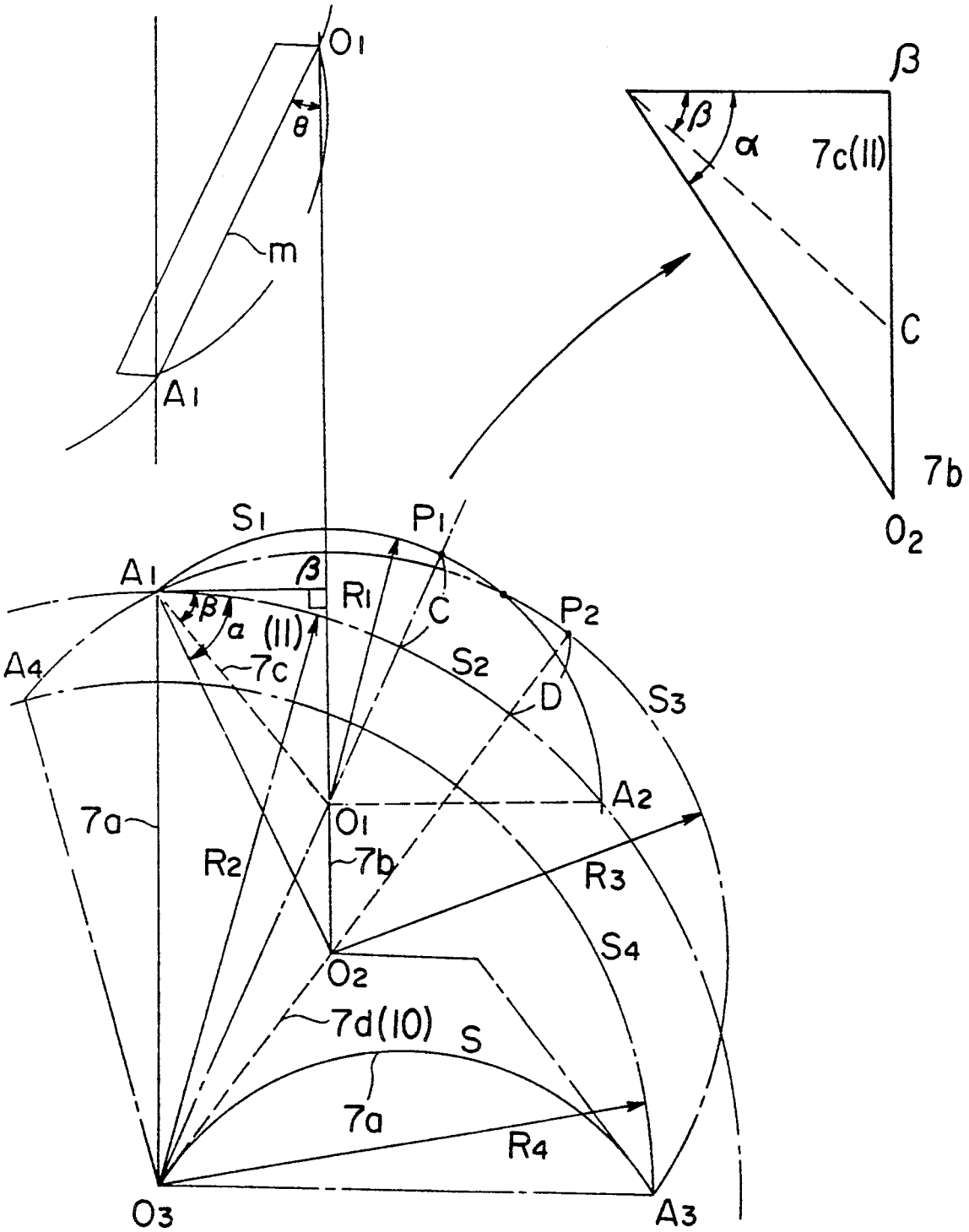

The bottom side 7a of the resilient belt plate 7 is formed to be expanded upwardly when the lid 3 is opened, and a crossing point $A_4$ at the forward side of the arcs $S_3$ and $S_4$ is positioned more forwardly than a base end point $O_3$ of the bottom sides 7a of the resilient belt plates 7 (i.e. as shown in FIG. 5 viewed from the side, it may fulfill a relation of $\angle A_4, O_3, O_2 = \angle O_2, O_3, A_3 > 45°$). With such an arrangement, the upper end $A_1$ of the bottom side 7a of the resilient belt plate is further apt to move up to a position of the point $A_4$ with a resilient retaining strength returning to an arc form under a state of the closed lid, so that a certain force may act in such a direction as one to close the lid 3 and the closed state of the lid can be positively maintained.

Second Preferred Embodiment

Figure 6:
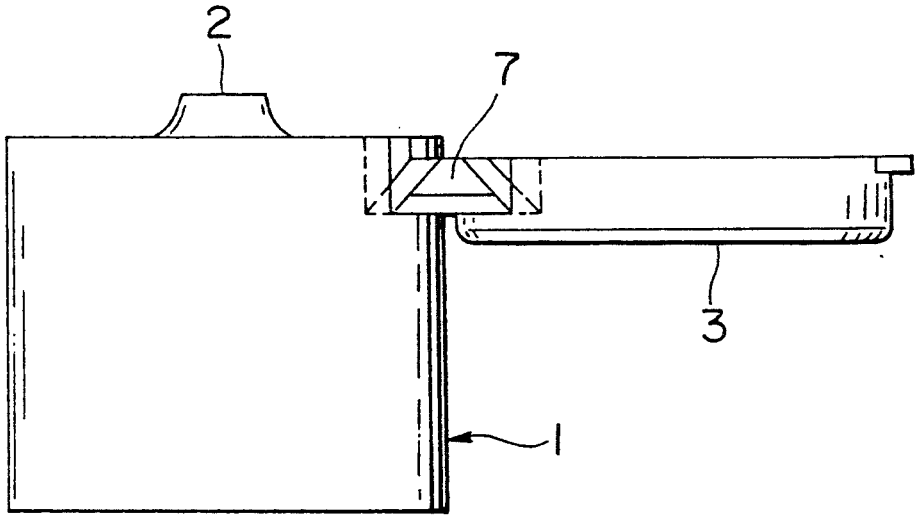
FIGS. 6 to 9 illustrate the second preferred embodiment.
Figure 7:
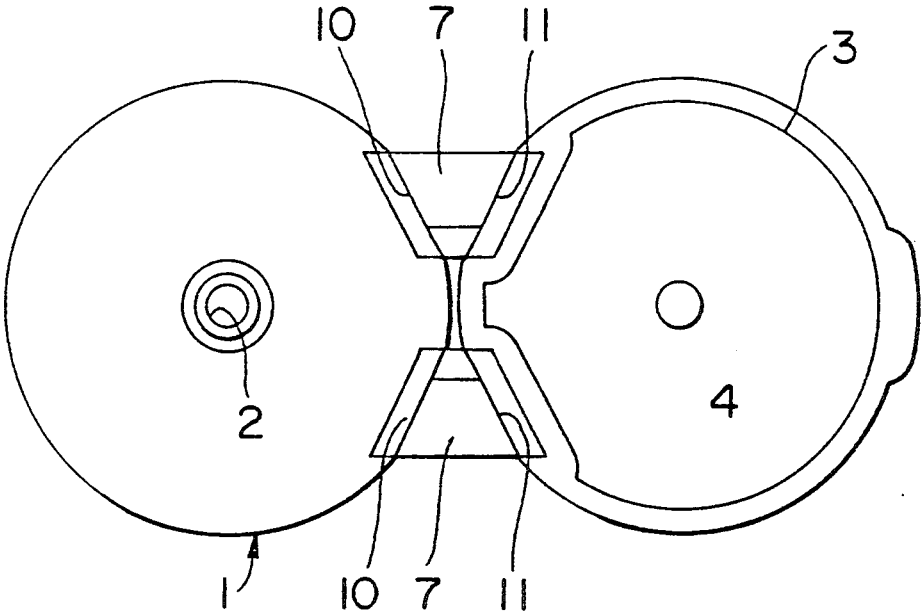

As shown in FIGS. 6 and 7, this second preferred embodiment is constructed such that the resilient belt plates 7 may keep their flat plate states when the lid 3 is opened.

Figure 8:
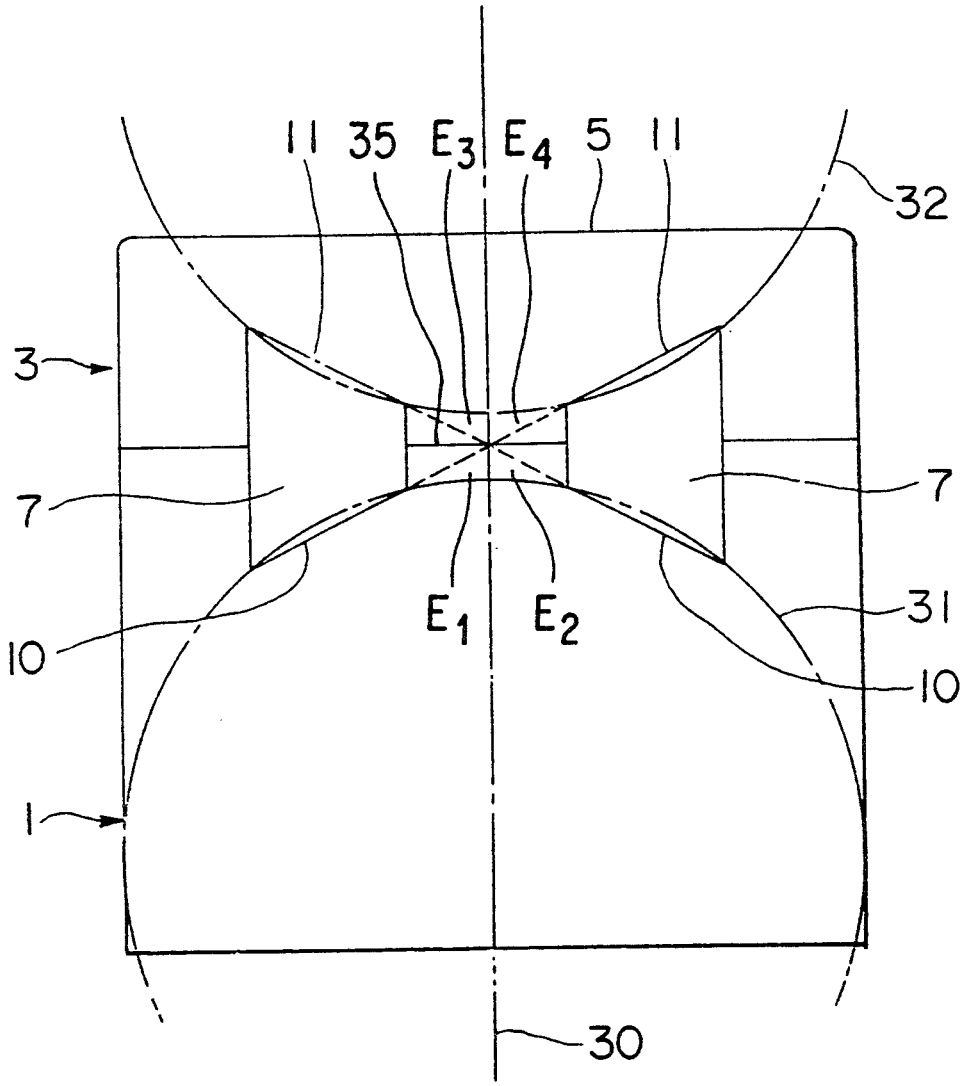

As shown in FIG. 8, an extension line $E_1$ of the lower thin-walled hinge 10 of one resilient belt plate 7 is crossed with an another extension line $E_2$ of the lower thin-walled hinge 10 of the other resilient belt plate 7 over a center line 30 between each of the resilient belt plates 7 and over an interface line 35 between the main body 1 and the lid 3 and at the same time at this crossing point, an extension line $E_3$ of the upper thin-walled hinge 11 of one resilient belt plate 7 is crossed with an other extension line $E_4$ of the upper thin-walled hinge 11 of the other resilient belt plate 7.

Figure 9:
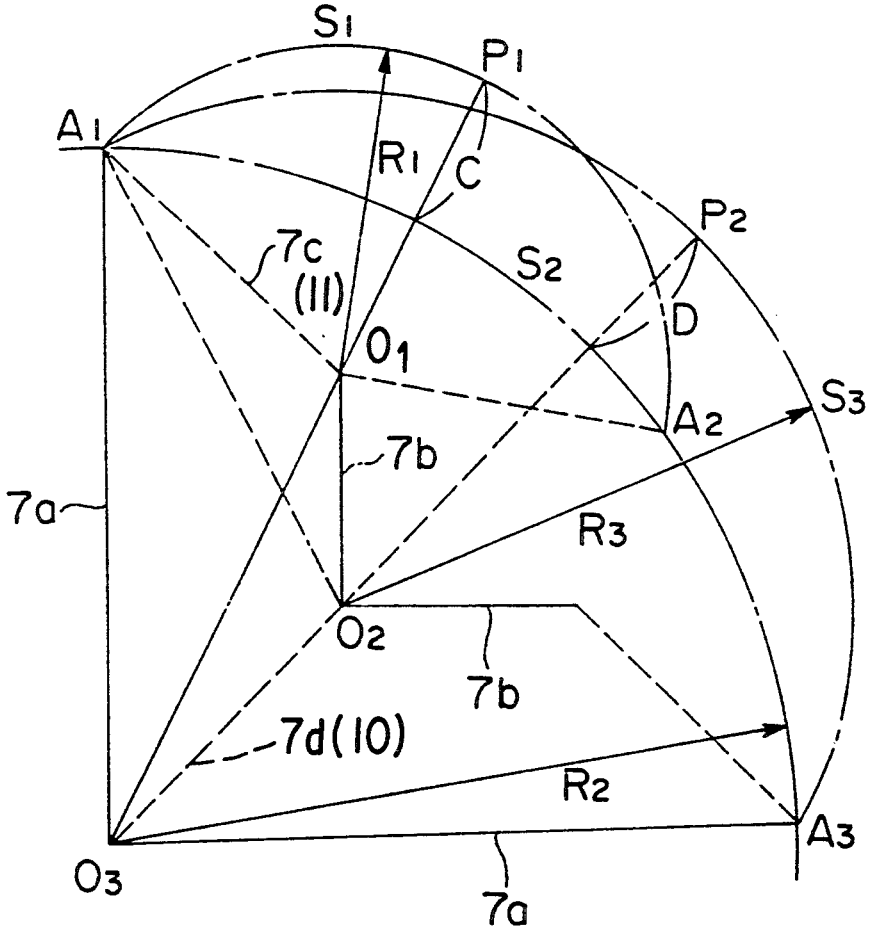

A lid opening operation in this preferred embodiment will be described in reference to FIG. 9, wherein at first when the lid 3 is pivoted on a crossing point $O_1$ between the top side 7b and the upper thin-walled hinge (an upper slant side) 7c a crossing point $A_1$ between the bottom sides 7a of the resilient belt plate 7 and the upper slant sides 7c is moved on an arc $S_1$ with a radius of a distance $R_1$ between $O_1$ and $A_1$ as viewed from a side while the point $O_1$ being a center when the lid 3 is pivoted.

To the contrary, when the lid 3 is pivoted on a crossing point $O_3$ between the bottom side 7a and the lower thin-walled hinge (a lower slant side) 7d , the crossing point $A_1$ between the bottom side 7a and the upper slant side 7c of the resilient belt plate 7 is moved on an arc $S_2$ with a radius having a length $R_2$ of the bottom side 7a.

Due to this fact, the resilient belt plate 7, in particular, its bottom side 7a resiliently extends from the point $A_1$ up to the intermediate point $P_1$ applying the maximum spacing distance C between each of the arcs $S_1$ and $S_2$ and as it exceeds this intermediate point $P_1$, it is apt to resiliently recover up to the point $A_2$. With such an arrangement, the primary reversing operation is completed.

Then, when the lid is pivoted on a crossing point $O_2$ between the top side 7b and the lower thin-walled hinge (a lower slant side) 7d the crossing point $A_1$ between the bottom side 7a and the upper slant side 7c of the resilient belt plate 7 is moved over an arc $S_3$ with a radius of a distance $R_3$ between $O_2$ and $A_1$.

To the contrary, when the lid 3 is pivoted on the crossing point $O_3$ between the bottom side 7a and the lower thin-walled hinge (a lower slant side) 7d, the crossing point $A_1$ between the bottom side 7a and the upper slant side 7c of the resilient belt plate 7 is moved on the arc $S_2$ with a radius having a length $R_2$ of the bottom side 7a.

Due to this fact, the resilient belt plate 7, in particular, its bottom side 7a is resiliently extended from the point $A_1$ up to the intermediate point $P_2$ applying the maximum spacing distance D between each of the arcs $S_3$ and $S_2$ and when it exceeds this intermediate point $P_2$, it is resiliently recovered after it and then the secondary reversing operation is completed. As a result, a cross-sectional shape crossing at a right angle with the resilient belt plates 7 becomes a truncated shape.

Third Preferred Embodiment

Figure 10:
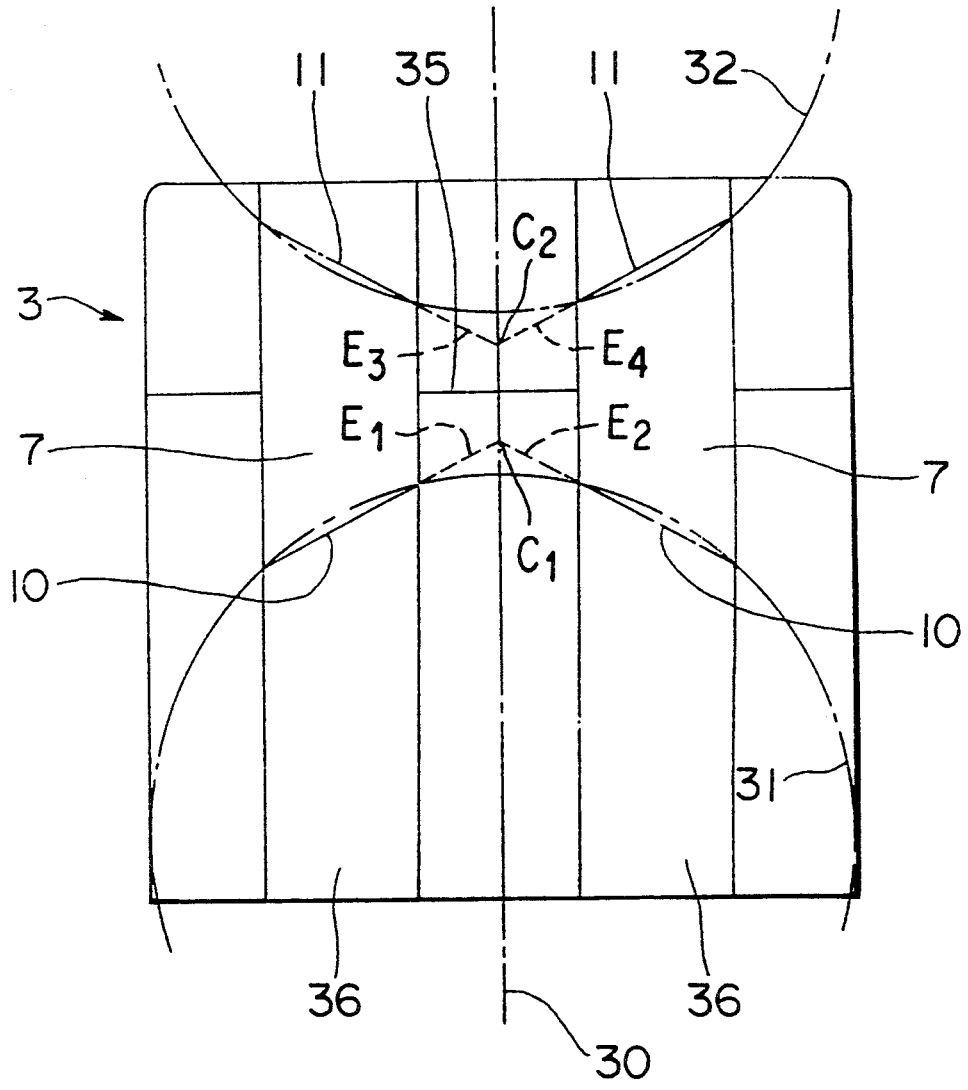
FIG. 10 is a rear view for showing the third preferred embodiment.

As shown in FIG. 10, this preferred embodiment is made such that an extension line $E_1$ of the lower thin-walled hinge 10 of one of the resilient belt plate 7 is crossed with another extension line $E_2$ of the lower thin-walled hinge 10 of the other resilient belt plate 7 over a center line 30 between each of the resilient belt plates 7 and at the same time this crossing point is positioned lower than an interface line 35 between the main body 1 and the lid 3, and an extension line $E_3$ of the upper thin-walled hinge 11 of one of the resilient belt plate 7 is crossed with another extension line $E_4$ of the upper thin-walled hinge 11 of the other resilient belt plate 7 over the center line 30 between each of the resilient belt plates 7 and at the same time this crossing point is positioned upper than the interface line 35 between the main body 1 and the lid 3.

Each of the crossing points $C_1$ and $C_2$ is placed at an equal distance from the interface line 35 between the main body 1 and the lid 3, and the resilient belt plates 7 are symmetrically arranged around the interface line 35 between the main body 1 and the lid 3.

A plane 36 including thin-walled hinges 10 and 11 for connecting each of the resilient belt plates 7 to the main body 1 and the lid 3 is formed at the rear surfaces of the main body 1 and the lid 3.

In this preferred embodiment, when the lid 3 is opened as shown in FIG. 6, a distance between the lid 3 and the main body 1 is made large, so that a machining of a molding die is facilitated. Since the thin-walled hinges 10 and 11 are included in the plane 36, it becomes easy to design the die in view of this fact.

Fourth Preferred Embodiment

Figure 11:
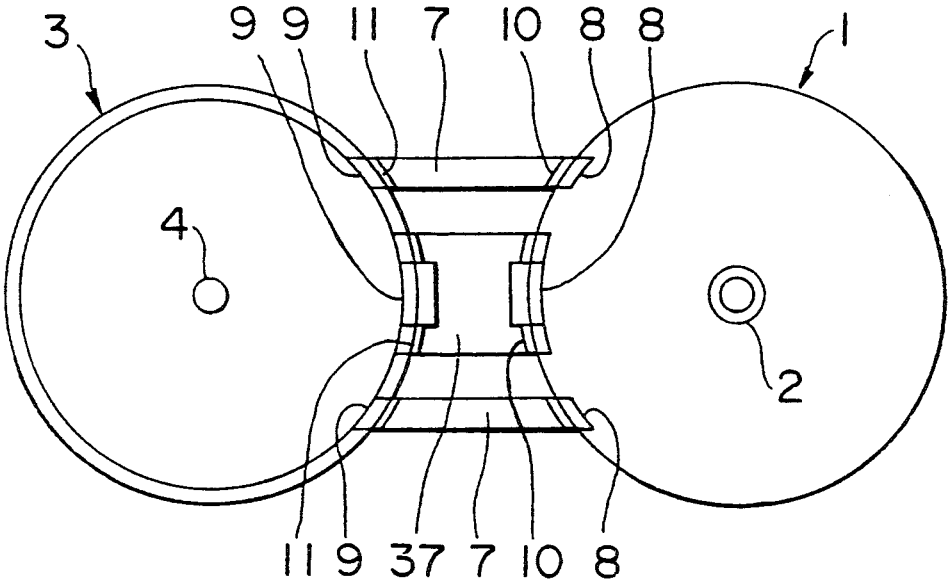
FIGS. 11 to 13 show the fourth preferred embodiment.
Figure 13:
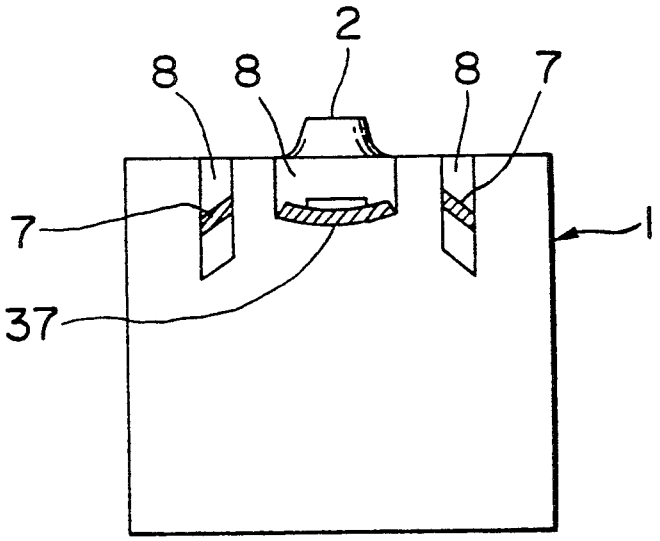
Figure 12:
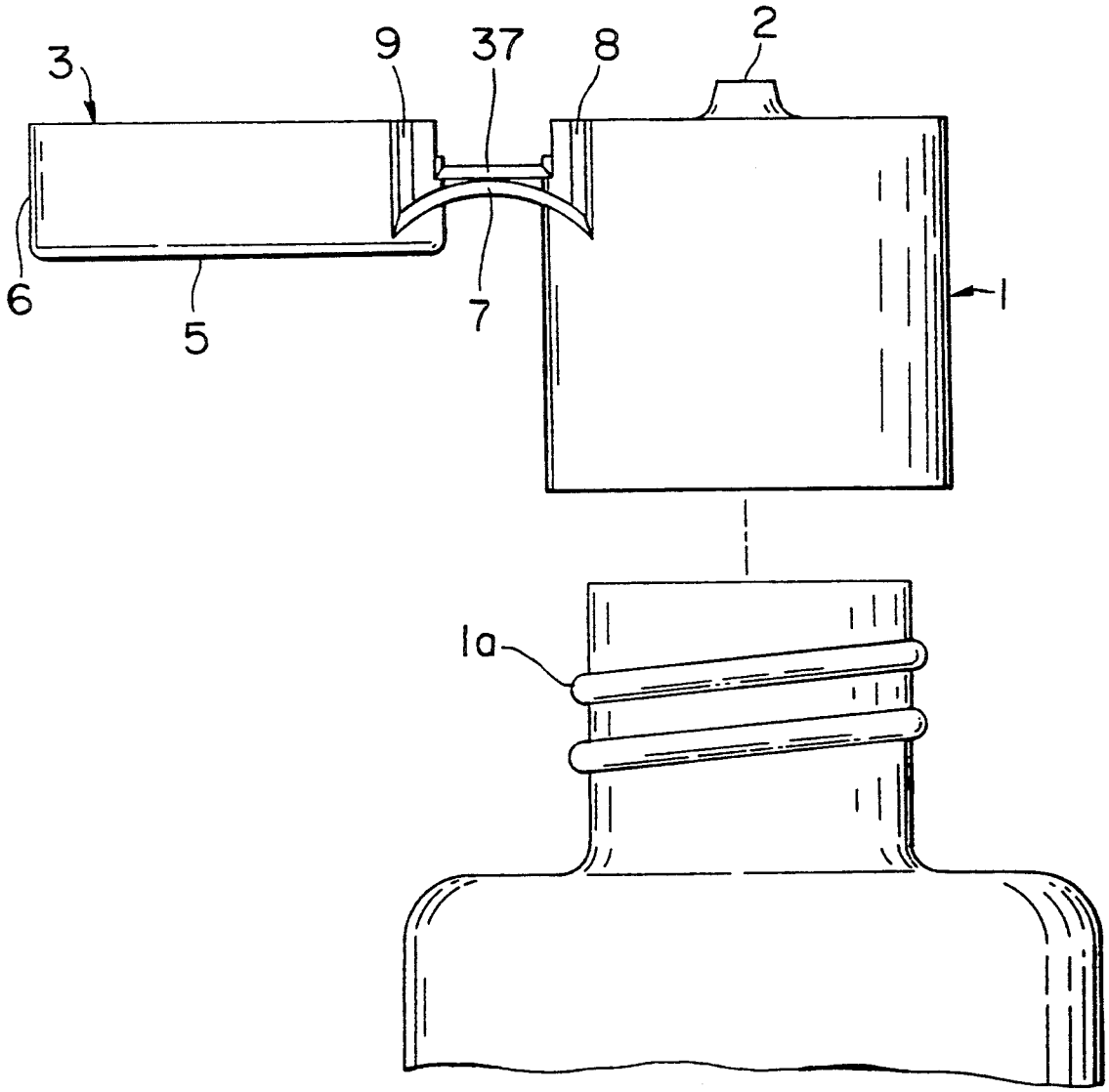

FIGS. 11 to 13 illustrate a cap in which the main body 1 is threadably engaged with an opening neck 1*a* of a container at its inner surface.

There are provided at least a pair of resilient belt plates 7 for connecting the rear side surface of the main body 1 and the lid 3 to each other in the same manner as that of the first preferred embodiment and they are stored in the grooves 8 and 9 in the same manner as that of the first preferred embodiment. Each of the lower ends of the resilient belt plates 7 is connected to the lower ends of the grooves 8 and 9 through the thin-walled hinges 10, and each of the upper ends of the resilient belt plates 7 is connected to the thin-walled hinges 11 at the upper ends of the grooves 8 and 9.

The third resilient plate 37 is arranged between one resilient belt plate 7 and the other resilient belt plate 7 so as to connect the rear surfaces of the main body 1 and the lid 3.

The third resilient plate 37 has basically a rectangular form and the rear surfaces of the main body 1 and the lid 3 are connected through the thin-walled hinges 10 and 11. However, since an intermediate part of the hinge is cut, this becomes an H-shape as shown in FIG. 11.

The resilient belt plates 7 are curved upwardly while the lid is being opened.

The grooves 8 and 9 corresponding to the third resilient belt plate 37 may be eliminated.

What is claimed is:

1. A lid member for a container opening comprising:

a main body of circular cross-section having an opening at its upper surface and having a rear surface;

a lid having a rear surface and the same cross-sectional shape as that of said main body for closing said opening and mounted on the upper surface of said main body, the lid assuming an open position and a closed position; and at least two resilient belt plates connecting the rear surfaces of said main body and the lid to each other, wherein each of the resilient belt plates forming a trapezoid having a bottom side and a top side parallel to each other and a pair of slant sides each connecting an end of the bottom side and an end of the top side, the top sides of the resilient belt plates being oppositely faced to each other, one slant side of each of the resilient belt plates being a lower side and connected to the rear surface of said main body through a thin-walled hinge and the other slant side of each of the resilient belt plates being an upper side and connected to the rear surface of the lid through another thin-walled hinge, each of the resilient plates being connected to the rear surface of the main body and the rear surface of the lid to cause a cross-section crossing at a right angle with the resilient belt plates to draw an inverted truncated V-shape in the closed position of the lid, and each of the resilient belt plates primarily rotating as a pivoting of the lid around the upper thin-walled hinge when the lid is opened or closed and secondarily reversed when each of the resilient belt plates is pivoted around a lower thin-walled hinge to cause a cross-sectional shape crossing at a right angle with the resilient belt plates at the another thin-walled hinge becoming a truncated V-shape in the open position of the lid.

2. The lid member for a container opening according to claim 1 in which both ends of the lower thin-walled hinges of each of the resilient belt plates are placed on a curved line drawn to expand upwardly with a center of curvature on a center line between the two resilient belt plates as viewed from the rear surfaces of said main body and the lid, and both ends of the upper thin-walled hinges are formed to be placed on a line of a curved line drawn to expand downwardly with a center of curvature on a center line between the two resilient belt plates.

3. The lid member for a container opening according to claim 2 in which said main body and the lid are of a circular shape as viewed from their upper sides and a curvature of each of said curved lines is the same as that of the circular shape.

4. The lid member for a container opening according to claim 1 in which said main body is a cap main body to be fixed to an opening neck of the container.

5. The lid member for a container opening according to claim 1 in which said main body is a container and said opening is an opening of said container.

6. The lid member for a container opening according to claim 1 in which the bottom sides of said resilient belt plates are formed to expand upwardly when said lid is opening.

7. The lid member for a container opening according to claim 1 in which the resilient belt plates are formed to keep a flat plate state when said lid is opening.

8. The lid member for a container opening according to claim 1 in which an extension line of the lower thin-walled hinge of said one resilient belt plate is crossed with an extension line of a lower thin-walled hinge of the other resilient belt plate over a center line between each of the resilient belt plates and at the same time an extension line of an upper thin-walled hinge of said one resilient belt plate is crossed with an extension line of an upper thin-walled hinge of the other resilient belt plate over the center line between each of the resilient belt plates.

9. The lid member for a container opening according to claim 1 in which an extension line of the lower thin-walled hinge of said one resilient belt plates is crossed with an extension line of the lower thin-walled hinge of the other resilient belt plates over a center line between each of the resilient belt plates and over an interface line between the main body and the lid, and an extension line of the upper thin-walled hinge of said one resilient belt plate and an extension line of the lower thin-walled hinge of the other resilient belt plate are crossed to each other at this crossing point.

10. The lid member for a container opening according to claim 1 in which an extension line of the lower thin-walled hinge of said one resilient belt plate is crossed at a first crossing point with an extension line of the lower thin-walled hinge of the other resilient belt plate over the center line between each of the resilient belt plates, the first crossing point being placed lower than the interface line between the main body and the lid, and in which an extension line of the upper thin-walled hinge of said one resilient belt plate is crossed at a second crossing point with an extension line of the upper thin-walled hinge of the other resilient belt plate over the center line between each of the resilient belt plates, and the second crossing point is placed higher than the interface line between the main body and the lid.

11. The lid member for a container opening according to claim 1 in which an extension line of the lower thin-walled hinge of said one resilient belt plate is crossed at a first crossing point with an extension line of the lower thin-walled hinge of the other resilient belt plate over the center line between each of the resilient belt plates, and the first crossing point is placed lower than the interface line between the main body and the lid, an extension line of the upper thin-walled hinge of said one resilient belt plate is crossed at a second crossing point with an extension line of the upper thin-walled hinge of the other resilient belt plate over the center line between each of the resilient belt plates, and each of the first and second crossing points is equally spaced apart from the interface line between the main body and the lid.

12. The lid member for a container opening according to claim 1, further comprising a third resilient plate placed between said one resilient belt plate and the other resilient belt plate, wherein the third resilient plate is of a rectangular shape, and the rear surfaces of said main body and lid are connected to each other through the thin-walled hinges.

13. The lid member for a container opening according to claim 1 in which a plane including the thin-walled hinges connecting each of said resilient belt plates to the main body and the lid is formed at the rear surfaces of said main body and the lid.

* * * * *